US009993738B2

(12) United States Patent
Christiansen

(10) Patent No.: US 9,993,738 B2
(45) Date of Patent: Jun. 12, 2018

(54) YOYO WITH PROPELLER BLADES

(71) Applicant: YOYOdrone, LLC, Bentonville, AR (US)

(72) Inventor: John Taylor Christiansen, Bentonville, AR (US)

(73) Assignee: YOYOdrone, LLC, Bentonville, AR (US)

( * ) Notice: Subject to any disclaimer, the term of this patent is extended or adjusted under 35 U.S.C. 154(b) by 0 days. days.

(21) Appl. No.: 15/659,472

(22) Filed: Jul. 25, 2017

(65) Prior Publication Data

US 2018/0028925 A1 Feb. 1, 2018

Related U.S. Application Data

(60) Provisional application No. 62/366,967, filed on Jul. 26, 2016.

(51) Int. Cl.

| | |
|---|---|
| ***A63H 27/127*** | (2006.01) |
| ***A63H 1/30*** | (2006.01) |
| ***A63H 1/24*** | (2006.01) |
| ***A63H 1/06*** | (2006.01) |

(52) U.S. Cl.

CPC ..... *A63H 1/30* (2013.01); *A63H 1/06* (2013.01); *A63H 1/24* (2013.01)

(58) Field of Classification Search

None

See application file for complete search history.

(56) References Cited

U.S. PATENT DOCUMENTS 466,172 A * 12/1891 Leeb ..... A63H 27/14 446/42
507,010 A * 10/1893 Jackson ..... A63H 27/14 446/40
527,013 A * 10/1894 Diers ..... A63H 27/14 446/42
693,328 A * 2/1902 Morgan ..... A63H 27/14 416/192
804,972 A 11/1905 Pioch (Continued)

FOREIGN PATENT DOCUMENTS

KR 10-2012-0130576 A 12/2012

OTHER PUBLICATIONS

International Search Report and Written Opinion, as issued in connection with International Patent Application No. PCT/US2015/067384, dated Mar. 17, 2016, 10 pgs.

(Continued)

*Primary Examiner* — John E Simms, Jr.
*Assistant Examiner* — Urszula M Cegielnik
(74) *Attorney, Agent, or Firm* — Maschoff Brennan

(57) ABSTRACT

In an example embodiment, a yoyo includes an axle, a first body and a second body coupled to the axle, and a string windable about the axle within a gap between the first body and the second body. The first body includes an outer rim and multiple propeller blades that extend inward from the outer rim toward the axle. The gap between the first body and the second body is smaller than three times a diameter of the string. A diameter of the axle is no larger than one sixth of the diameter of the first or second outer rim. An aggregate mass of the first and second outer rims is at least one quarter of an aggregate mass of the yoyo, string excluded.

20 Claims, 11 Drawing Sheets

(56) References Cited

U.S. PATENT DOCUMENTS

| | | | | | |
|---|---|---|---|---|---|
| 1,222,996 | A | * | 4/1917 | Rhodes | A63H 27/14 446/42 |
| 1,260,957 | A | * | 3/1918 | Benjamin | A63H 27/14 446/41 |
| 1,332,175 | A | * | 2/1920 | Soiohi | A63H 27/14 446/40 |
| 1,604,461 | A | * | 10/1926 | McGahey | A63H 27/14 446/42 |
| 1,631,539 | A | | 6/1927 | Larrair | |
| 1,783,627 | A | | 12/1930 | Orazio | |
| 1,907,815 | A | * | 5/1933 | Edward | A63H 27/14 446/41 |
| 2,051,151 | A | * | 8/1936 | Northrop | A63H 27/12 446/40 |
| 2,623,327 | A | | 12/1952 | Testino | |
| 2,802,299 | A | * | 8/1957 | Lohr | A63H 27/12 446/40 |
| 3,246,424 | A | * | 4/1966 | Gregory | A63H 27/14 446/40 |
| D221,453 | S | * | 8/1971 | Swanberg | 416/179 |
| 3,935,663 | A | | 2/1976 | Leibowitz | |
| 4,138,939 | A | | 2/1979 | Feld | |
| 5,066,258 | A | | 11/1991 | Tomberlin | |
| 5,080,624 | A | * | 1/1992 | Brinker | A63H 27/12 446/266 |
| 5,195,916 | A | | 3/1993 | Her | |
| 5,254,027 | A | | 10/1993 | McAvoy, Jr. | |
| 5,349,898 | A | | 9/1994 | Po Wo Cheung | |
| 5,356,328 | A | | 10/1994 | Ho | |
| 5,545,068 | A | * | 8/1996 | Asbaghi | A63H 27/14 446/260 |
| 6,113,456 | A | | 9/2000 | Hadzicki | |
| 6,196,890 | B1 | | 3/2001 | Amaral | |
| 6,206,749 | B1 | | 3/2001 | Bell | |
| 6,221,409 | B1 | * | 4/2001 | Bueno Ceresuela | A23G 3/50 426/104 |
| 6,612,817 | B2 | | 9/2003 | Lin | |
| 6,776,680 | B2 | | 8/2004 | Chow | |
| 6,887,122 | B1 | | 5/2005 | Van Dan Elzen | |
| 7,125,310 | B1 | | 10/2006 | Van Dan Elzen | |
| 2003/0119415 | A1 | | 6/2003 | Kaisio | |
| 2008/0210409 | A1 | | 9/2008 | Saksager | |
| 2009/0130943 | A1 | | 5/2009 | Norman | |
| 2010/0112894 | A1 | | 5/2010 | Smith | |
| 2011/0009029 | A1 | | 1/2011 | Van Dan Elzen | |
| 2011/0059672 | A1 | * | 3/2011 | Davis | A63H 27/12 446/45 |
| 2011/0212665 | A1 | | 9/2011 | Van Dan Elzen | |
| 2011/0294392 | A1 | | 12/2011 | Lee | |
| 2012/0244781 | A1 | | 9/2012 | Smith | |
| 2012/0276806 | A1 | | 11/2012 | Wu | |
| 2013/0165015 | A1 | | 6/2013 | Sekido | |
| 2016/0184720 | A1 | | 6/2016 | Christiansen | |

OTHER PUBLICATIONS

10ft string, Snyder S., Feb. 23, 2012 [online], retrieved on Feb. 22, 2016, retrieved from the Internet, https://www.youtube.com/watch?v=VfBbBzn_Rxw, entire document, 1 pg.

Mullicabob's Powder Coating, RHOADS C., Sep. 1, 2014 [online], retrieved Feb. 5, 2016, retrieved from the Internet, http://www.highspeedyoyo.com/reviews/n-z/yoyo-services/mullicabobs-powder-coating, 11 pgs.

* cited by examiner

YOYO WITH PROPELLER BLADES

CROSS-REFERENCE TO RELATED APPLICATION

This application claims the benefit of and priority to U.S. Provisional App. No. 62/366,967, filed Jul. 26, 2016, which is incorporated herein by reference.

FIELD

Example embodiments described herein relate to a yoyo with propeller blades.

BACKGROUND

Unless otherwise indicated, the materials described in the background section are not prior art to the claims in the present application and are not admitted to be prior art by inclusion in this section.

The yoyo is a toy which originated with the ancient Greek and is more than 2400 years in use. In its simplest form, the yoyo consists of an axle connected to two disks, and a length of string looped around the axle, similar to a slender spool. It is played by holding the free end of the string known as the handle (usually by inserting one finger in a slip knot) allowing gravity or the force of a throw to spin the yoyo and unwind the string, then allowing the yoyo to wind itself back to one's hand, exploiting its spin and the associated rotational energy.

Many inventions exist which minimize the friction between the axle and the string. Lower friction results in the ability for the yoyo to spin freely while the string is completely unwound. Softly touching the yoyo to the ground while it is thus spinning creates a forward or reverse motion for the yoyo and is a common trick with the yoyo.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF SOME EXAMPLE EMBODIMENTS

Example embodiments described herein relate to a yoyo with propeller blades.

In an example embodiment, a yoyo includes an axle, a first body and a second body coupled to the axle, and a string windable about the axle within a gap between the first body and the second body. The first body may include a first outer rim and multiple first propeller blades that extend inward from the first outer rim toward the axle. The second body may include a second outer rim and multiple second propeller blades that extend inward from the second outer rim toward the axle. The first and second outer rims may have the same diameter. The gap between the first body and the second body is smaller than three times a diameter of the string. The diameter of the axle is no larger than one sixth of the diameter of the first or second outer rim. An aggregate mass of the first and second outer rims is at least one quarter of an aggregate mass of the yoyo, string excluded. The foregoing three critical features enable a product which can be thrown with a smooth swinging motion of the hand and arm.

In another example embodiment, a yoyo includes a first body rotatable about an axis of rotation, a second body coupled to the first body and rotatable about the axis of rotation, and a string seat. The second body may be directly coupled to the first body, or indirectly coupled to the first body through an intervening component, such as a bolt. The first body includes a first outer rim and multiple first propeller blades that extend radially inward from the first outer rim. The second body includes a second outer rim and multiple second propeller blades that extend radially inward from the second outer rim. The string seat axially separates the first body from the second body. The string seat constitutes an axle between the two bodies, whether the string seat is comprised of a connecting object, such as a bolt, or of components of the two bodies. A string is windable and unwindable about the string seat to cause rotation of the yoyo about the axis of rotation. Three features of this embodiment which are critical to its ease of use are as follows. First, the gap between the first body and second body shall be smaller than three times the diameter of the string. Second, the diameter of the axle between the two bodies shall be no larger than one sixth of the diameter of the outer rims. Third, the mass of outer rims shall be at least one quarter of the mass of the overall object, string excluded. These three critical features enable a product which can be thrown with a smooth swinging motion of the hand and arm.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Figure 1:
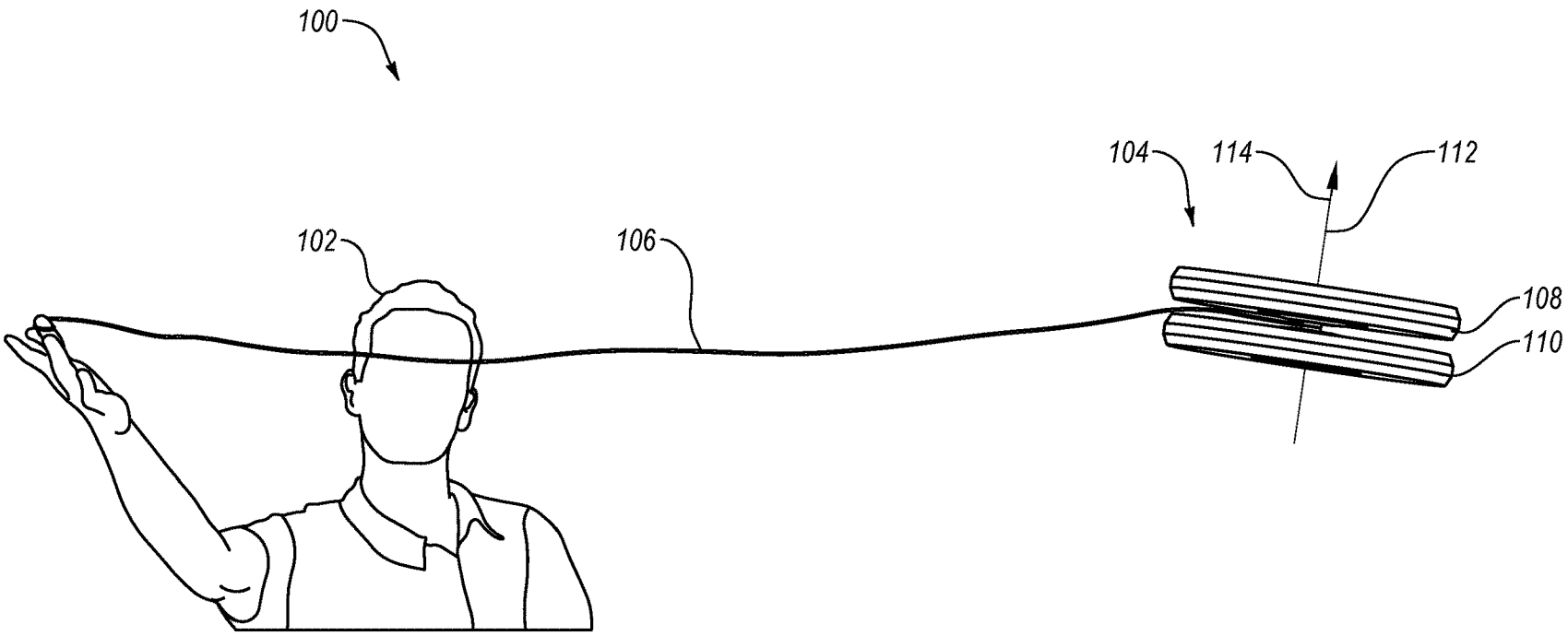
FIG. 1 illustrates an example operating environment.

Example embodiments described herein improve upon U.S. Patent Publication No. 2016/0184720 A1, which is incorporated herein by reference in its entirety.

In an effort to utilize the spin of a yoyo to create thrust, U.S. Pat. No. 5,066,258 to Tomberlin discloses a returning flying toy which incorporates propellers into a yoyo mechanism. A string is connected to an axle of Tomberlin's toy. Extending outward from the axle on both sides of the string are propellers which create thrust when the yoyo is thrown. Edge guards are proposed as two ring-shaped objects, each connected to the outer ends of the propellers, one on each set of propellers on both sides of the string.

Tomberlin emphasizes a user motion of snapping the wrist when throwing Tomberlin's toy in describing the use of Tomberlin's toy. It is herein proposed that the need for such a snapping of the wrist is due to Tomberlin's failure to identify and develop critical features which make such an object more easily thrown by the user. Tomberlin discloses a device which lacks at least three critical elements for much-improved ease of use for the user.

First, Tomberlin's bodies which bound the string as it is wound around the axle are too far apart relative to the diameter of the string. For instance, FIGS. 3 and 5 of Tomberlin (e.g., the only detailed elevation views of Tomberlin's toy) illustrate a gap between these bodies which is about four times a diameter of the string. Tomberlin's wide gap results in the string not reaching a sufficiently large winding radius when wound around the axle. In contrast to Tomberlin's toy which will necessarily have a relatively small winding radius even when the string is fully wound due to the relatively wide gap, some embodiments described herein have a relatively narrow gap between bodies which results in a relatively larger winding radius when the string is fully wound around the axle. The relatively larger winding radius according to some embodiments described herein increases the torque placed on the yoyo by the string when the yoyo is thrown compared to a yoyo like Tomberlin's with a relatively small winding radius. The increased torque in turn results in an increase in rotational speed and therefore an increase in thrust provided by propeller blades of the yoyo as disclosed herein compared to Tomberlin's toy with its relatively small winding radius even when Tomberlin's string is fully wound around Tomberlin's axle.

Second, the diameter of Tomberlin's axle is too large relative to the diameter of the edge guards. Tomberlin illustrates the axle as having a diameter of about one fifth of the diameter of the outer edge guards. The relatively high ratio of these two measurements in Tomberlin's toy results in a jerky motion at the moment when the string is unwound completely and begins to wind back onto the axle. According to some embodiments disclosed herein, however, a ratio of the diameter of the axle about which the string is wound to a diameter of the two bodies that make up the yoyo may be no larger than (e.g., may be less than) one sixth so as to reduce (compared to Tomberlin's toy) or eliminate any jerky motion at the moment when the string is unwound completely and begins to wind back onto the axle.

Third, Tomberlin appears to disclose the edge guards with minimal mass relative to the mass of the overall toy. A low mass of Tomberlin's edge guards relative to the mass of the overall toy results in lower inertia of the toy as it spins. Lower inertia, in turn, results in more-rapid reduction in the rate of rotation and reduction in thrust created. As such, it may be difficult for a user to throw Tomberlin's toy horizontally with sufficient initial rotational speed to avoid being dropped to the ground before returning to the user due to reduced rotational speed due to losses and low inertia and consequent reduced thrust as Tomberlin's toy travels to the end of the string and then back to the user. In comparison to Tomberlin's toy, outer rims of each body of a yoyo according to some embodiments described herein may have much higher mass relative to the mass of the overall yoyo. As such, a reduction in rotational speed (and consequently a reduction in vertical thrust) of horizontally-thrown yoyos according to some embodiments described may be much less than the reduction in rotational speed of Tomberlin's toy due to the higher mass of outer rims of a yoyo as disclosed herein relative to the mass of the overall yoyo.

As best understood by the inventor of the instant invention, it appears the Tomberlin toy has not been commercialized in more than two decades since Tomberlin was filed, indicating deficiencies in the user experience of the Tomberlin toy, as described above.

Reference will now be made to the drawings to describe various aspects of some example embodiments of the invention. The drawings are diagrammatic and schematic representations of such example embodiments, and are not limiting of the present invention, nor are they necessarily drawn to scale.

FIG. 1 illustrates an example operating environment 100, arranged in accordance with at least one embodiment described herein. In the operating environment 100, a user 102 plays a yoyo 104 using a string 106 of the yoyo 104. The yoyo 104 includes first and second bodies 108 and 110 that rotate about an axis of rotation 112. One or both of the first and second bodies 108 and 110 may include propeller blades that impart a thrust 114 on the yoyo 104 in a direction that is parallel to the axis of rotation 112. As used herein, terms such as "first," "second," and other ordinal terms may be used to distinguish between multiple otherwise similarly-named components without denoting an order or preference unless context dictates otherwise.

As illustrated in FIG. 1, when the yoyo 104 is thrown in a generally horizontal direction with the axis of rotation 112 generally arranged vertically, the thrust 114 may generally be directed in a vertical upward direction to counteract, or at least partially counteract, the effects of gravity. As a result, the yoyo 104 may return to the user 102 generally horizontally without dropping, or without dropping as much as yoyos that lack propeller blades.

The thrust 114 imparted by rotation of the propeller blades may allow the string 106 of the yoyo 104 to be longer than strings used in other yoyos. In particular, other yoyos that lack propeller blades may lack thrust to counteract the effects of gravity. As such, other yoyos may be limited to use with strings that are generally shorter than a maximum distance between ground (or any other surface on which a user is standing) and the user's hand that is holding a handle of the string. Strings in these other yoyos may be around four feet or less to avoid a situation where the use throws or drops the yoyo and the yoyo hits ground before reaching an end of the string.

In comparison, the string 106 may have a length greater than a maximum distance between ground and the hand of the user 102. For instance, the string 106 may have a length greater than four feet, such as a length of four feet or more, ten feet, twenty feet, thirty feet, or even forty feet or longer. Without the thrust 114 imparted by rotation of the propeller blades, the yoyo 104 may fall to ground before returning to the user 102 with such a long string 106. However, the thrust 114 imparted by the propeller blades counteracts or at least partially counteracts the effects of gravity so that the yoyo 104 may return to the user 102 without hitting ground even when the string 106 is relatively long.

Figure 2A:
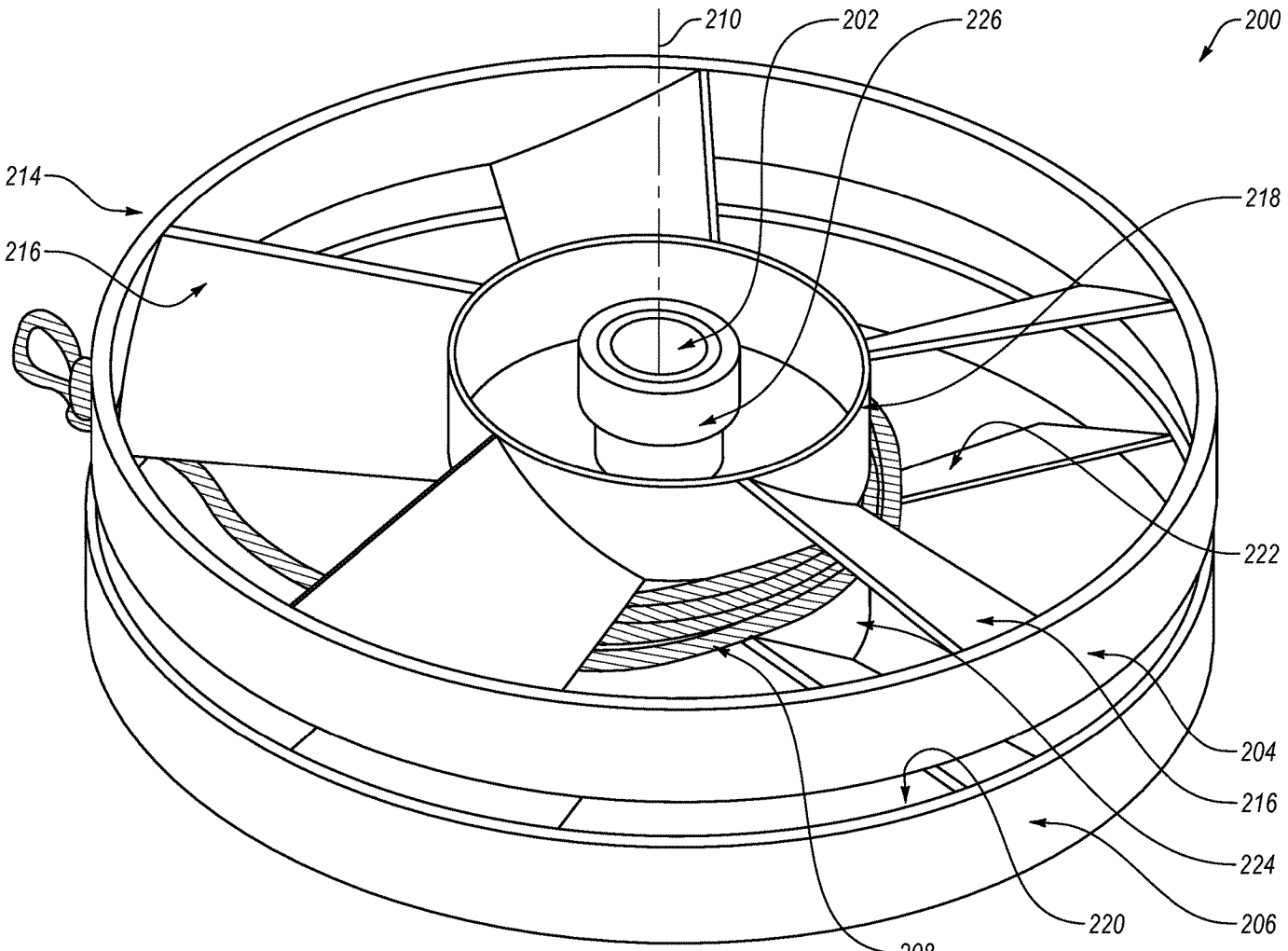
FIGS. 2A and 2B include a perspective view and an exploded perspective view of an example yoyo and FIG. 2C includes an enlarged view of a portion thereof.
Figure 2B:
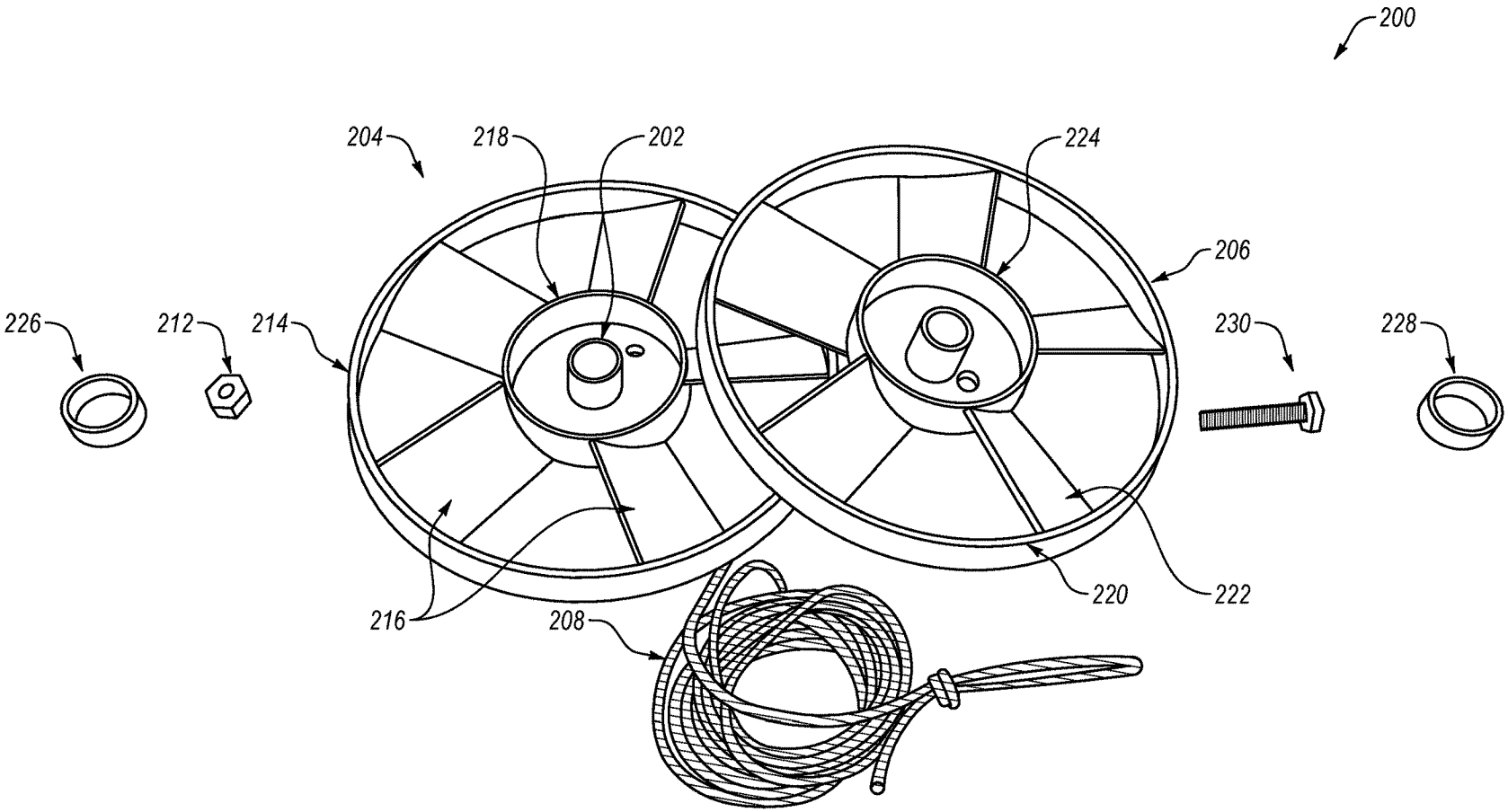

FIGS. 2A and 2B include a perspective view and an exploded perspective of an example yoyo 200, arranged in accordance with at least one embodiment described herein.

The yoyo 200 may include or correspond to the yoyo 104 of FIG. 1. As illustrated in FIGS. 2A and 2B, the yoyo 200 includes an axle 202, first and second bodies 204 and 206, and a string 208. The first and second bodies 204 and 206 and the string 208 may include or correspond to the first and second bodies 108 and 110 and the string 106 of FIG. 1.

The first body 204 and the second body 206 are both coupled to the axle 202 that defines an axis of rotation 210 of the yoyo 200. In the illustrated embodiment, the axle 202 includes a bolt 230. The first and second bodies 204 and 206 may be coupled to the axle 202 by inserting the bolt 230 through holes defined in each of the first and second bodies 204 and 206 and attaching a nut 212 to the threaded end of the bolt 230 to prevent the first and second bodies 204 and 206 from being removed from the axle bolt 230.

The axle 202 may be formed of some combination of members of the first and second bodies 204 and 206 with the bolt 230. In some embodiments the axle may be formed without the use of a bolt, wherein the first and second bodies are coupled directly to each other and members of bodies 204 and 206 form the axle or string seat, around a portion of which the string 208 is wound.

The string 208 may be wound around a string seat of the yoyo 200, described in more detail below with respect to FIGS. 3A and 3B. With the string 208 wound around the string seat of the yoyo 200, the yoyo 200 may be played by throwing the yoyo 200, with the string 208 unwinding and causing the yoyo 200 to rotate. The string seat of the yoyo 200 may include one or more members of one or both of the first and second bodies 204, 206 that extend across a gap between other components (e.g., outer rim, propeller blades, drum) of the first and second bodies 204, 206.

The first body 204 includes a first outer rim 214 and first propeller blades 216, only some of which are labeled for simplicity. The first propeller blades 216 extend inward from the first outer rim 214, e.g., toward the axle 202 in FIG. 2A. More generally, the first propeller blades 216 may extend inward from the first outer rim 214 towards a center of the first outer rim 214. The first body 204 additionally includes a first drum 218 or hub. The first propeller blades 216 may extend between the first outer rim 214 and the first drum 218.

The second body 206 includes a second outer rim 220 and second propeller blades 222, only some of which are labeled for simplicity. The second propeller blades 222 extend inward from the second outer rim 220, e.g., toward the axle 202 in FIG. 2A. More generally, the second propeller blades 222 may extend inward from the second outer rim 220 towards a center of the second outer rim 220. The second body 206 additionally includes a second drum 224 or hub. The second propeller blades 222 may extend between the second outer rim 220 and the second drum 224.

The axle 202 and the first and second bodies 204 and 206, as well as all other components of the yoyo 200 excluding the string 208, may have an aggregate mass, referred to as the aggregate mass of the yoyo 200. The first and second bodies 204 and 206 include a first and second outer rim 214 and 220. These outer rims 214 and 220 may have an aggregate mass, referred to as the aggregate mass of the outer rims 214 and 220. The aggregate mass may be equal to a sum of a mass of the first outer rim 214 and a mass of the second outer rim 220. One critical feature of the invention is that the aggregate mass of the outer rims 214 and 220 be no smaller than one quarter of the aggregate mass of the yoyo 200, excluding the string 208. As described above, at relatively lower ratios of the aggregate mass of the outer rims 214 and 220 to the aggregate mass of the yoyo 200 (e.g., a ratio of less than one quarter or less than 0.25), the yoyo 200 would have relatively lower inertia, resulting in more rapid reduction in the rate of rotation and/or reduction in thrust of the yoyo 200 during use, which in turn would reduce or even eliminate the ability of the yoyo 200 to be thrown horizontally and return to a user before dropping to the ground.

The axle 202 may have a diameter where the string is wound, referred to as the axle diameter. The first and second outer rims 214 and 220 may have a diameter that is the same in some embodiments, referred to as the outer rim diameter. Another critical feature of the invention is that the axle diameter be no larger than one sixth of the outer rim diameter. As described above, when the ratio of the diameter of the axle about which the string is wound to the diameter of the outer rims is too high, the yoyo is subject to a jerky motion at the moment the string reaches its completely unwound state and begins to wind back onto the axle.

In some embodiments, the first and second drums 218 and 224 may be collectively referred to as a drum of the yoyo 200.

In FIGS. 2A and 2B, each of the first and second bodies 204 and 206 is illustrated as including multiple propeller blades 216 or 222. In other embodiments, only one, but not both, of the first and second bodies 204 and 206 includes multiple propeller blades 216 or 222. Alternatively or additionally, each of the first and second bodies 204 and 206 may have more or fewer propeller blades 216 or 222 than are illustrated in FIGS. 2A and 2B.

Each of the propeller blades 216 and 222 has a radially variable pitch or steepness. In particular, the pitch of each of the propeller blades 216 and 222 is relatively steep at the first or second drum 218 or 224 and decreases to a pitch at the first or second outer rim 214 or 220 that is less than the pitch at the first or second drum 218 or 224. In addition, each of the propeller blades 216 and 222 has the same general variable pitch. In other embodiments, the pitch of each of the propeller blades 216 and 222 may radially increase from the first or second drum 218 or 224 to the first or second outer rim 214 or 220. Alternatively or additionally, each of the propeller blades 216 or 222 may have a constant pitch from the first or second drum 218 or 224 to the first or second outer rim 214 or 220. Alternatively or additionally, each of the propeller blades 216 or 222 within a given one of the first or second bodies 204 or 206 may have different variable or constant pitches. Alternatively or additionally, the propeller blades 216 of the first body 204 may have a different pitch than the propeller blades 222 of the second body 206.

Each of the propeller blades 216 and 222 has a pitch direction that may be clockwise or counterclockwise. Clockwise and counterclockwise pitch directions are considered herein to be opposite pitch directions. As used herein, pitch direction may refer to a direction of rotation of the first or second body 204 or 206 when oriented so the axis of rotation 210 is generally vertical that results in a generally upward thrust. In the example of FIGS. 2A and 2B, the propeller blades 216 and 222 may have a clockwise pitch direction. In particular, when the first and second bodies 204 and 206 are oriented with the axis of rotation 210 generally vertical, rotation of the first and second bodies 204 and 206 clockwise about the axis of rotation 210 may result in a generally upward thrust.

In FIGS. 2A and 2B, the propeller blades 216 of the first body 204 and the propeller blades 222 of the second body 206 have the same clockwise pitch direction. In other embodiments, the propeller blades 216 of the first body 204 may have an opposite pitch direction from the propeller blades 222 of the second body 206.

In addition, in FIGS. 2A and 2B, each of the first and second outer rims 214 and 220 may have a cylindrical shape. In other embodiments, one or both of the first or second outer rims 214 or 220 may have a frustoconical shape or other suitable shape.

Each of the first and second bodies 204 and 206 may be injection molded or formed in any other suitable manner from the same material, such as ABS plastic, polycarbonate, aluminum, or other suitable material or materials. In other embodiments, each of the first and second bodies 204 and 206 may have a core made from one material, e.g., hard plastic, and an outer layer made from a softer material, e.g., rubber. In an example embodiment, the first and second bodies 204 and 206 are formed from the same mold such that they are identically formed and both are made of polycarbonate for strength to withstand repeated impact with a user's hand and/or environment (e.g., walls, ground, other objects) during use.

Alternatively or additionally, the yoyo 200 may include removable mass to adjust a mass of the yoyo 200. For example, the yoyo 200 may include silicone rubber bands or other removable components that may be attached to or removed from one or both of the first or second bodies 204 or 206 to adjust the mass of the yoyo 200. When attached to the outer rims 214, 220, such attachments should be considered as part of the outer rim mass as described above and included when considering the critical feature of the relationship of the aggregate mass of the outer rims to the aggregate mass of the yoyo.

As described above, the first and second outer rims 214 and 220 have an aggregate mass that is at least one quarter of the aggregate mass of the yoyo 200, excluding the string 208. In these and other embodiments, at least some portions of each of the first and second bodies 204 and 206 other than the first and second outer rims 214 and 220 may be relatively thin-walled to concentrate mass at the first and second outer rims 214 and 220, which may be relatively thicker-walled. For instance, a thickness of each of the first and second propeller blades 216 and 222 and of walls that make up the first and second drums may be less than 1.5 millimeters (mm), while a thickness of each of the first and second outer rims 214 and 220 may be more than 2 mm. Alternatively or additionally, the thickness of each of the first and second propeller blades 216 and 222 may be less than 1 mm while the thickness of each of the first and second outer rims 214 and 220 may be about 2.5 mm. In these and other embodiments, the first and second bodies 204 and 206 may be made of polycarbonate to withstand repeated impact with a user's hand and/or environment during use.

Figure 2C:
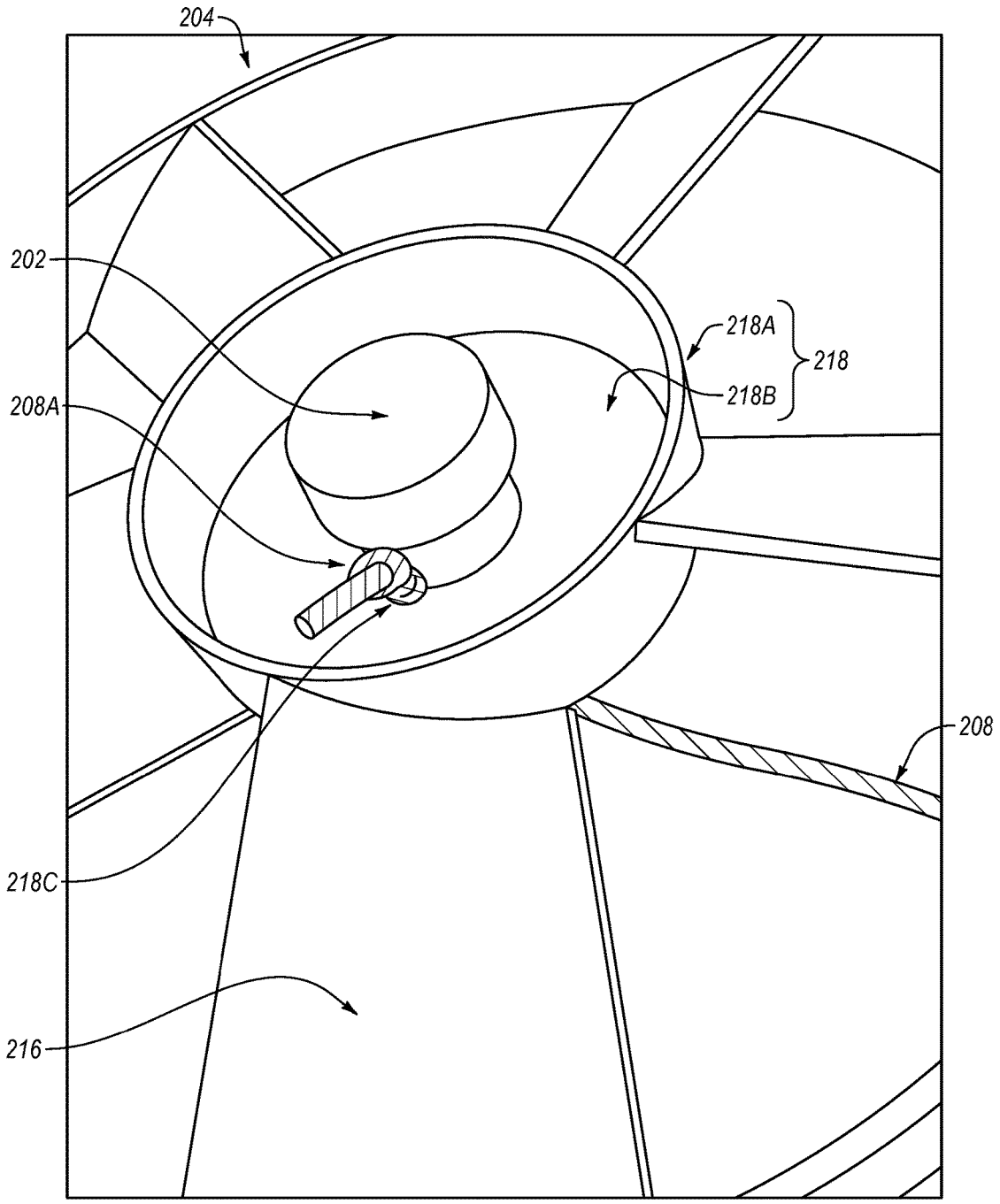

FIG. 2C is a detail view of the first body 204 of FIGS. 2A and 2B, arranged in accordance with at least some embodiments described herein. The second body 204 may have the same or similar features. As illustrated in FIG. 2C, the first drum 218 includes a cylindrical wall 218A and a circular base 218B from which the cylindrical wall 218 extends axially outward. The circular base 218B defines one side of a gap (see, e.g., gap 341 of FIG. 3B) between the first and second bodies 204 and 206, the other side of the gap being defined by a circular base of the second drum 224 of the second body 206. In the illustrated embodiment, the first propeller blades 216 are coupled to and extend between the first outer rim 214 and the cylindrical wall 218A of the first drum 218. Although not illustrated in FIG. 2C, the first drum 218C may further include a relatively small cylindrical wall that extends inward (e.g., into the gap) from the circular base 218B. The relatively small cylindrical wall that extends inward from the circular base 218B may form a string seat, together with a similar relatively small cylindrical wall of the second drum 224 of the second body 206, about which the string 208 is windable. A diameter of the string seat, (e.g., of each of the relatively small cylindrical walls) may satisfy the constraint described elsewhere that a ratio of the diameter of the string seat to the diameter of the first or second outer rim 214 or 220 is less than one sixth.

In some embodiments, the circular base 218B of the first drum 218 defines a hole 218C through which the string 208 passes. In particular, a knot 208A may be tied at one end of the string 208 on the "outside" of the circular base 218B, the string 208 passing through the hole 218C in the circular base 218B to the "inside" of the circular base 218B so that the string 208 is located inside the gap between the first and second bodies 204 and 206 when assembled together. The "inside" of the circular base 218B refers to a side of the circular base 218B that is exposed to the gap between the first and second bodies 204 and 206 when assembled together. In contrast, the "outside" of the circular base 218B refers to a side of the circular base 218B that is opposite the "inside". The knot 208A prevents the end of the string 208 from passing through the hole 218C. In some embodiments, the first and second bodies 204 and 206 can be easily unscrewed from each other and screwed back together, which combined with the string attachment method of FIG. 2C allows the user to easily replace the string 208 should it wear out. Alternative string attachment methods involve heat sealing an end of the string to the yoyo and/or using a looped yoyo string, which methods result in a string that is not replaceable (in the case of heat sealing) or that is more expensive to produce (looped yoyo string) compared to the string attachment method of FIG. 2C.

Figure 3A:
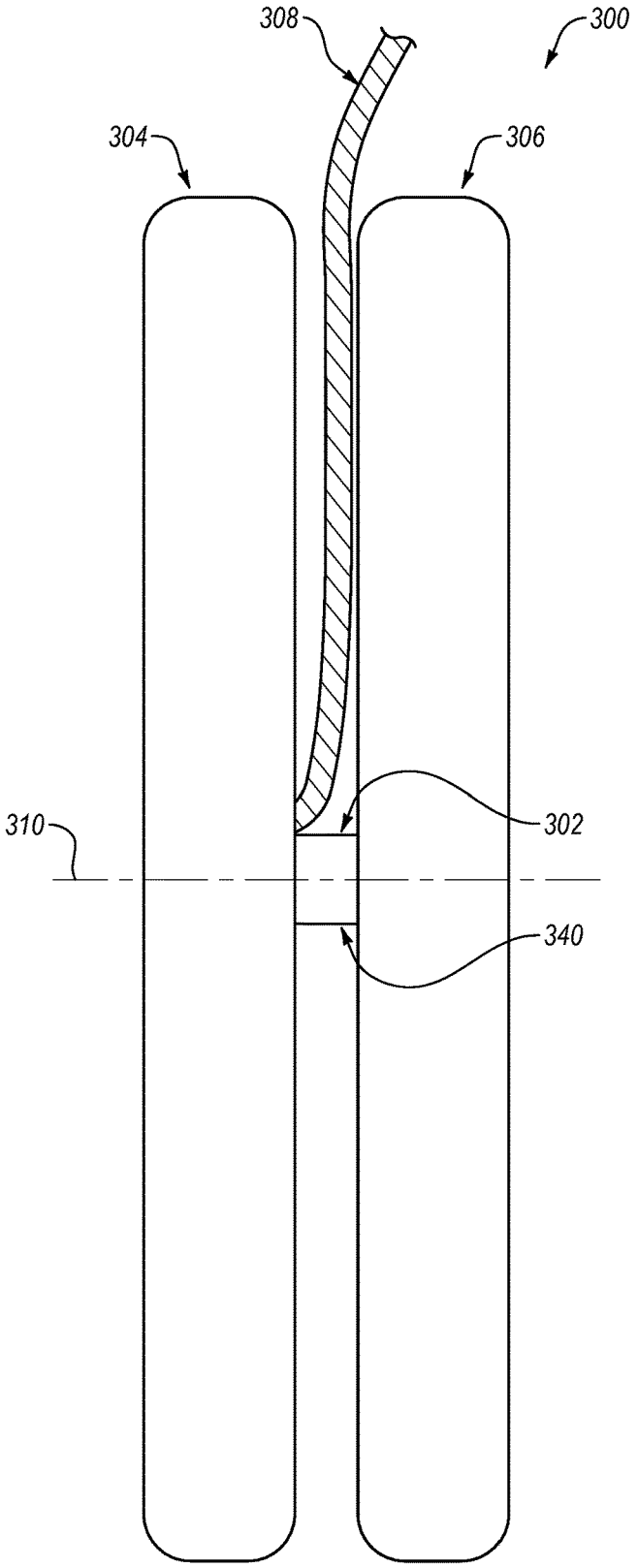
FIGS. 3A and 3B include a side view and an enlarged side view of an example yoyo.
Figure 3B:
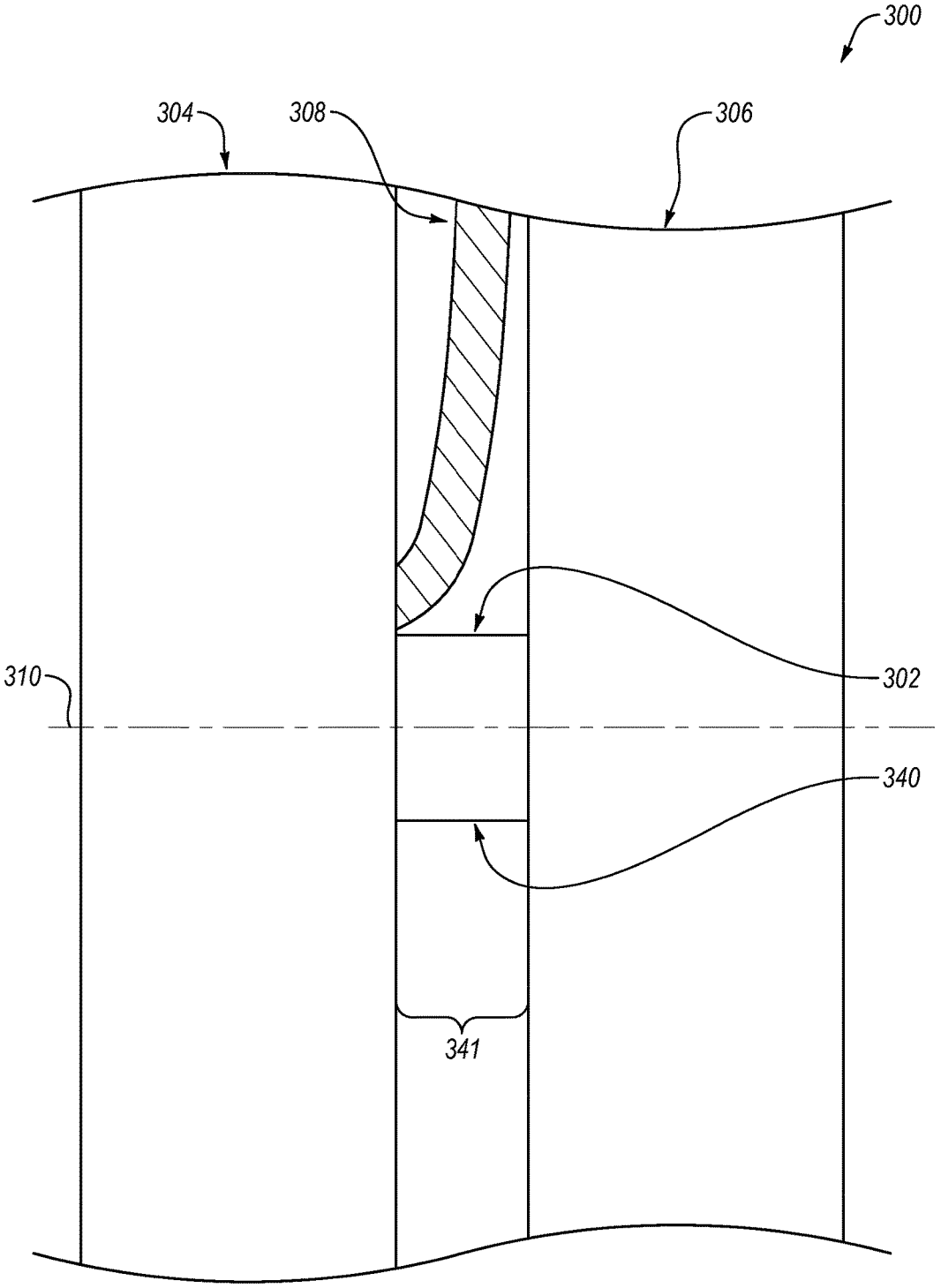

FIGS. 3A and 3B include a side view and an enlarged side view of an example yoyo 300, each arranged in accordance with at least one embodiment described herein. The yoyo 300 may include or correspond to the yoyo 104 of FIG. 1, or the yoyo 200 of FIGS. 2A and 2B.

The yoyo 300 of FIGS. 3A and 3B includes a first body 304 and a second body 306, an axle 302, an axis of rotation 310 and a string seat 340. Regarding the first body 304, the second body 306 and the axis of rotation 310, they may generally be similar in form and/or function to the first bodies 108, 204, and the second bodies 110, 206, and the axes of rotation 112, 210 described above unless otherwise noted.

The string seat 340 axially separates the first body 304 from the second body 306. A string 308, which may generally be similar in form and/or function to the strings 106, 208 described above unless otherwise noted, may be windable and unwindable about the string seat 340 to cause rotation of the yoyo 300 about the axis of rotation 310.

The first and second bodies 304, 306 may be separated by a gap 341 (FIG. 3B). The gap 341 may be as narrow as the diameter of the string 308 or larger. One critical feature of the invention is that the size (or width) of the gap 341 between the first body 304 and the second body 306 be smaller than three times the diameter of the string 308. As described above, when the ratio of the width of the gap 341 to the diameter of the string 308 is too high (e.g., greater than 3), the string 308 will not reach a sufficiently large winding radius to impart sufficiently large torque (and thus sufficiently large rotational speed and thrust).

Figure 4A:
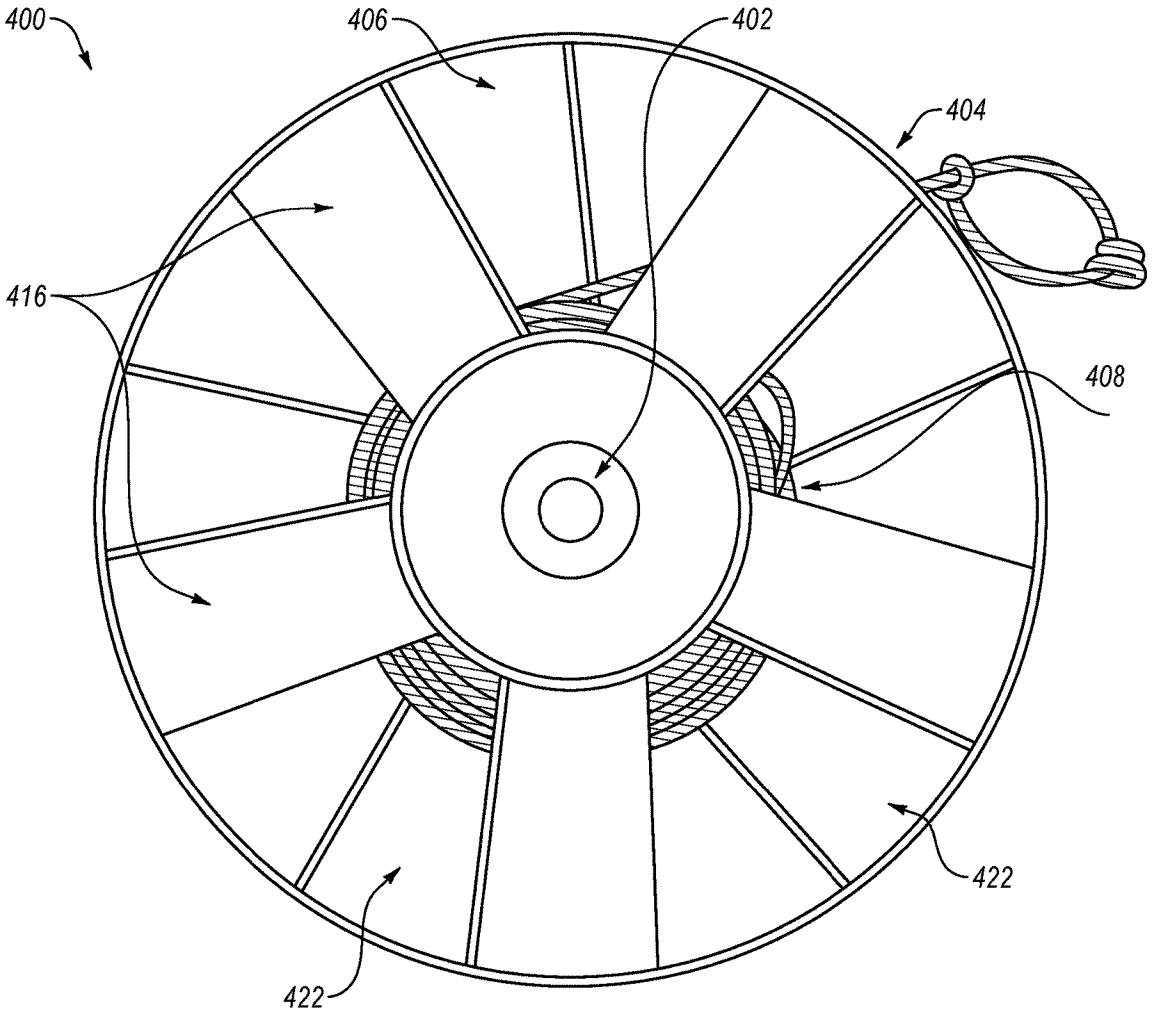
FIGS. 4A and 4B include top views of an example yoyo, one in which a string is wound about the axle and one in which the string is not wound about the axle.
Figure 4B:
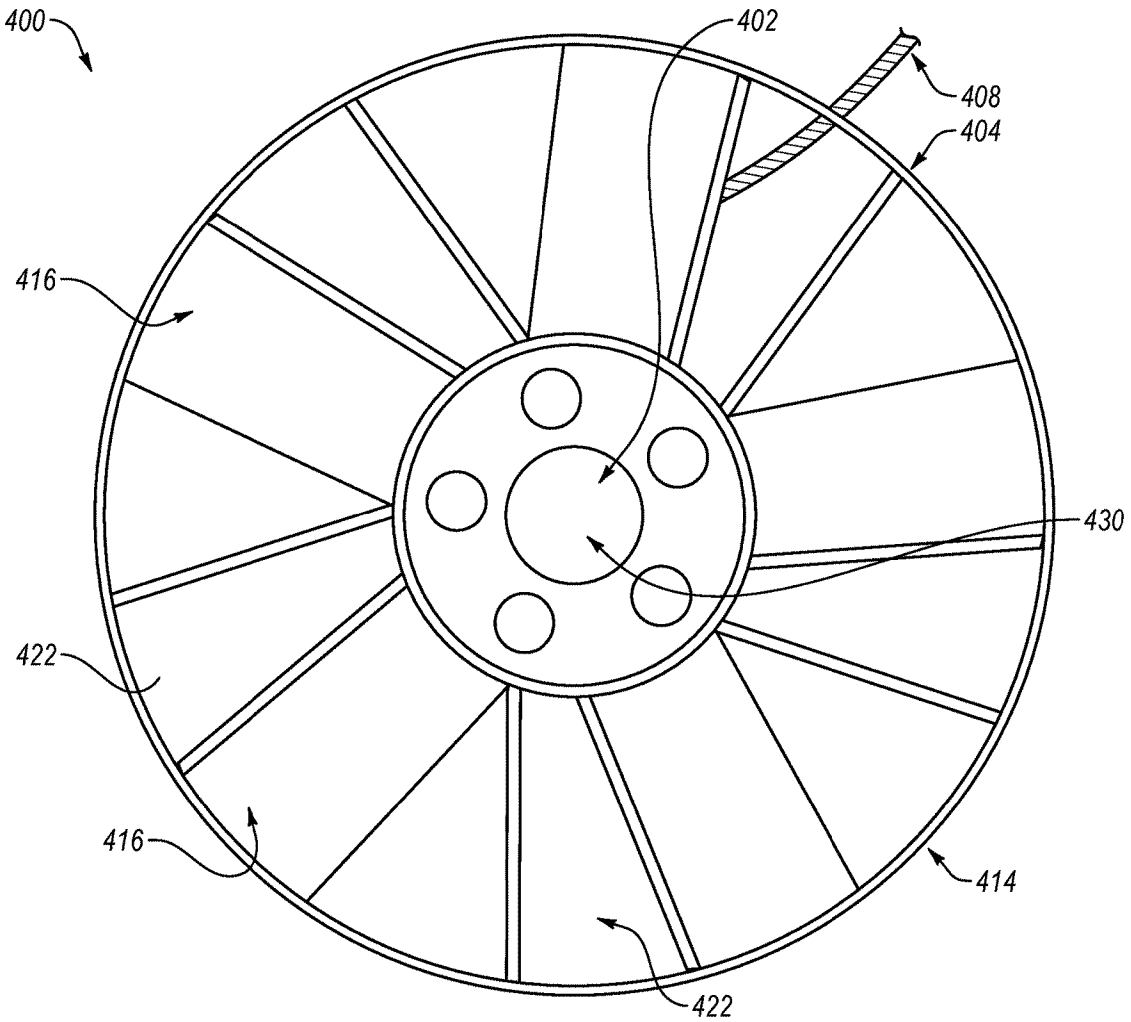

FIGS. 4A and 4B include top views of an example yoyo 400 with a string 408, arranged in accordance with at least one embodiment described herein. In FIG. 4A, the string 408 is wound about an axle 402 of the yoyo 400. In FIG. 4B, the string 408 is not wound about the axle 402. The yoyo 400 additionally includes a first body 404 and a second body 406.

A portion of one or both of the first body 404 and of the second body 406 form a string seat of the axle 402 around which the string 408 is wound. The wound string 408 of FIG. 4A may be bounded primarily by a drum of each of the first and second bodies 404 and 406, which may be similar or identical to the first and second drums 218 and 224 of FIGS. 2A-2B. Alternatively or additionally, the wound string 408 may be bounded by members of the first body 404 including propellers 416 and members of the second body 406 including propellers 422.

Figure 5A:
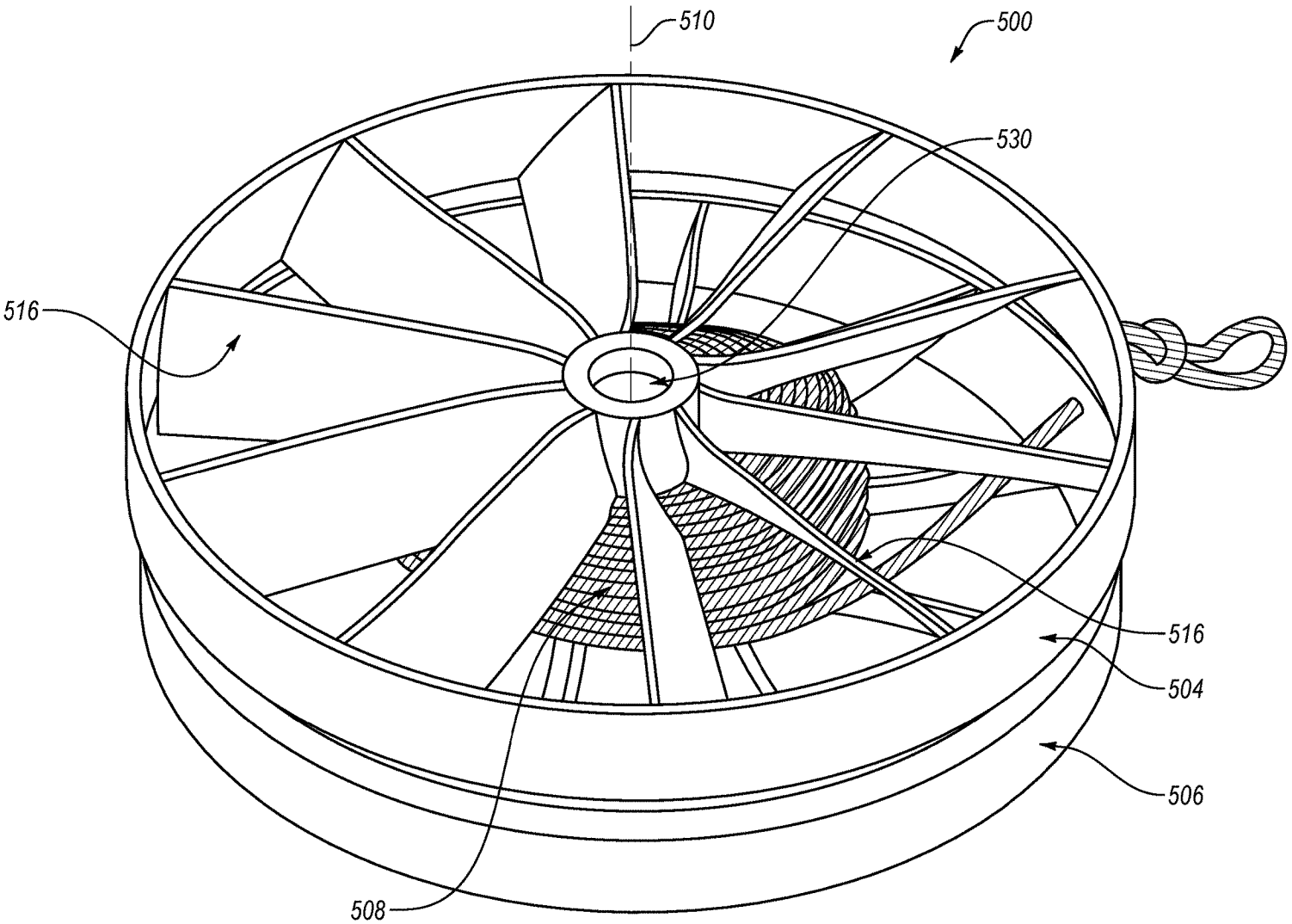
FIGS. 5A and 5B include a perspective view and a top view of another example yoyo.
Figure 5B:
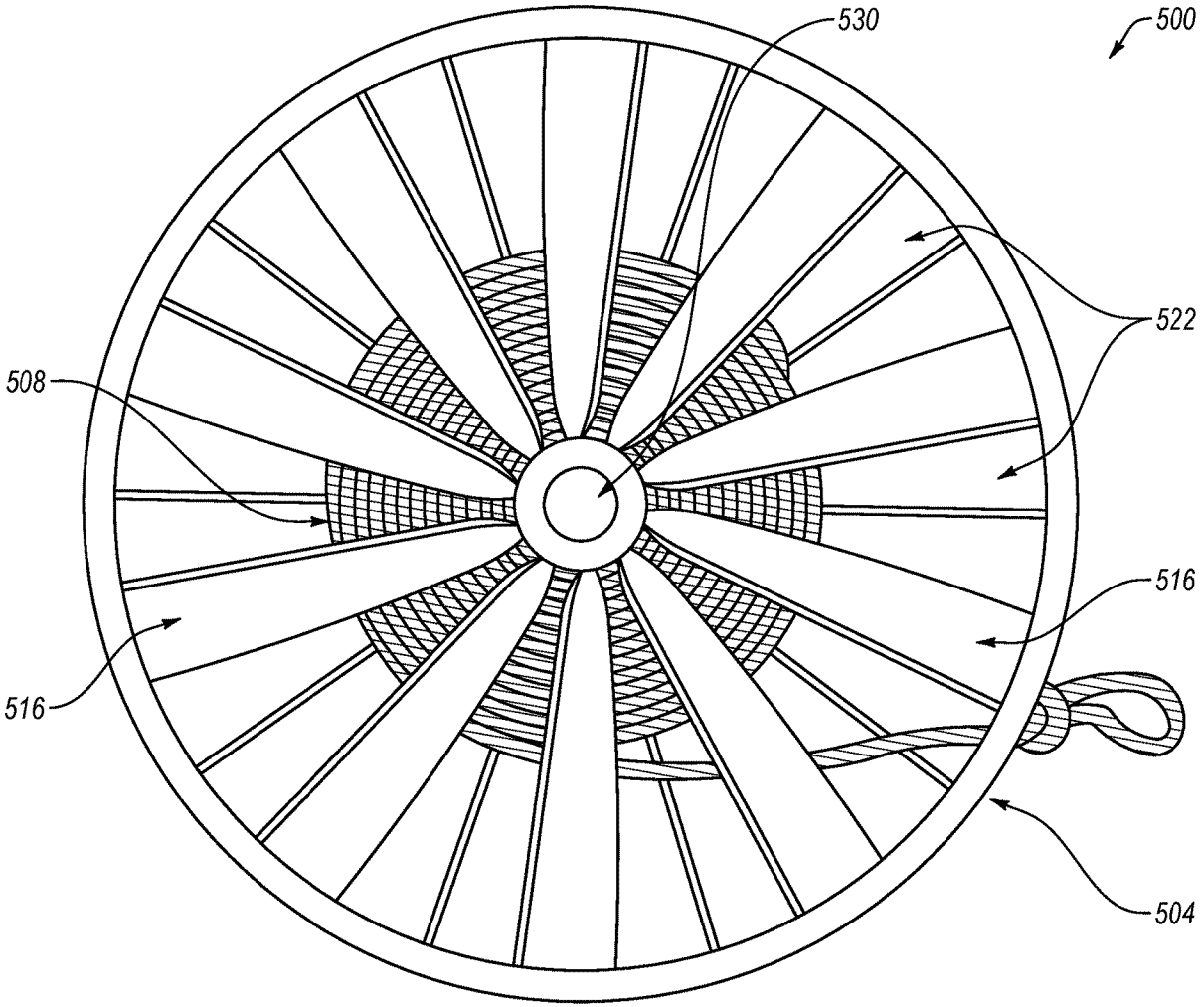

FIGS. 5A and 5B include a perspective view and a top view of another example yoyo 500, arranged in accordance with at least one embodiment described herein.

The yoyo 500 includes a first body 504 and a second body 506 which may be coupled together by a bolt 530 at the axis of rotation 510 (FIG. 5A). A string 508 is wound about a string seat or axle, which may surround the bolt 530 at least within a gap between the first and second bodies 504, 506. The wound string 508 of the yoyo 500 is bounded by members of the first body 504 including propellers 516 and members of the second body 506 including propellers 522. The wound string 508 is primarily bounded by the propellers 516 and 522 as opposed to embodiments above in which the majority of the wound string is bounded by the drum (e.g., as in FIG. 4A). Despite gaps between adjacent propellers 516 of the first body 504 and between adjacent propellers 522 of the second body 506, the propellers 516 and 522 nevertheless provide enough structure to limit and otherwise bound the string 508 generally within a gap between the first and second bodies 504, 506.

Figure 6:
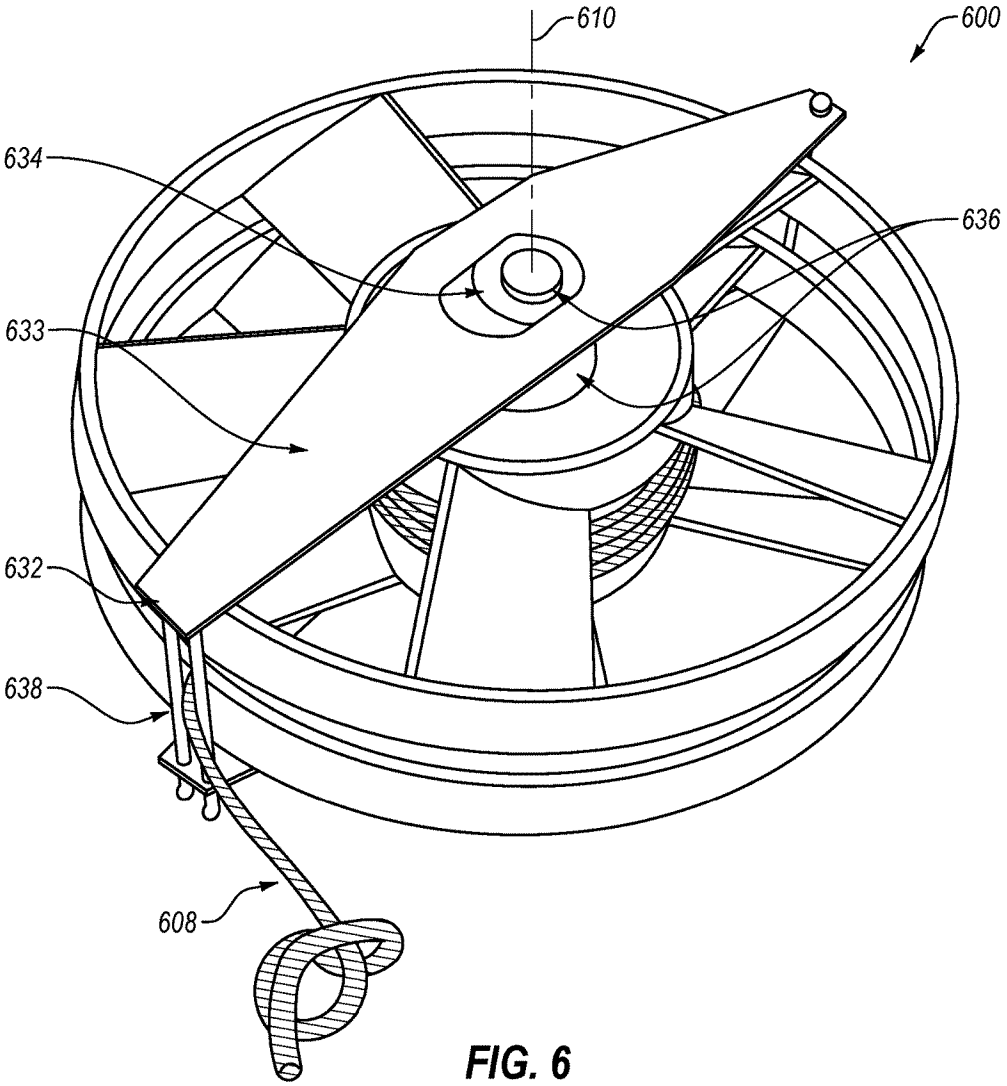
FIG. 6 includes a perspective view of another example yoyo fitted with a mounting apparatus; all arranged in accordance with at least one embodiment described herein.

FIG. 6 includes a perspective view of another example yoyo 600 fitted with a mounting apparatus 632, arranged in accordance with at least one embodiment described herein. The mounting apparatus 632 creates a structure to which various useful elements may be attached, including but not limited to a small digital camera.

The mounting apparatus 632 is comprised of at least one arm structure 633 which engages the string 608 and is connected to the yoyo 600 at the axis of rotation 610 such that the arm structure 633 rotates freely around the axis of rotation 610. Means for enabling rotation of the arm structure 633 relative to the yoyo 600 may include a bearing 634 connected to the arm structure 633 and to the yoyo 600 by a connector 636. Such a configuration allows the arm structure 633 to maintain a generally consistent orientation (e.g., non-rotating orientation) to the user while the yoyo 600 is rotating in flight. This would allow for consistent orientation of a small digital camera mounted to the arm structure 633. The "consistent orientation" to the user described above may include an orientation in which the arm structure 633 does not rotate about the axis of rotation 610, notwithstanding the arm structure 633 may translate away from and to the user as the string 608 of the yoyo 600 unwinds and then rewinds and/or may translate upwards and/or downwards relative to the user depending on, e.g., the yoyo's 600 initial vector of translation when released by the user, an amount of thrust imparted by propeller blades of the yoyo 600 as the string 608 unwinds and rewinds, and/or other factors.

As illustrated in FIG. 6, the mounting apparatus 632 may further include an eyelet 638. The eyelet 638 is located radially beyond the first and second outer rims of the yoyo 600. The eyelet 638 spans the gap between the first and second bodies of the yoyo 600. More generally, the eyelet 638 may at least partially span the gap between the first and second bodies. The string 608 may be threaded through the eyelet. Threading the string 608 through the eyelet 638 may be configured to maintain the generally consistent orientation of the arm structure to the user while the yoyo 600 is rotating in flight. In particular, because the mounting apparatus 632 and the rest of the yoyo 600 can rotate independently from each other, the string 608 threaded through the eyelet 638 will maintain the mounting apparatus 632 at a generally consistent orientation with respect to a user as the yoyo 600 unwinds and winds with respect to the string 608.

Although not illustrated, one or more of the yoyos 104, 200, 300, 400, 500, 600 described herein may include a bearing. For example, the bearing may include a ring bearing that surrounds at least a portion of a corresponding one of the axles 202, 302, 410. In these and other embodiments, a string of the yoyo may be windable around and unwindable from the bearing, an outer surface of which may serve as a string seat of the corresponding yoyo.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A yoyo, comprising:

an axle;

a first body and a second body coupled to the axle; and a string windable about the axle within a gap between the first body and the second body; wherein:

the first body comprises a first outer rim and multiple first propeller blades that extend inward from the first outer rim toward the axle;

the second body comprises a second outer rim with a diameter equal to a diameter of the first outer rim in the first body and multiple second propeller blades that extend inward from the second outer rim toward the axle;

the gap between the first body and the second body is smaller than three times a diameter of the string; and a diameter of the axle is no larger than one sixth of the diameter of the first or second outer rim; and an aggregate mass of the first and second outer rims is at least one quarter of an aggregate mass of the yoyo, string excluded.

2. The yoyo of claim 1, wherein the multiple first and second propeller blades are configured to impart a thrust on the yoyo in a direction parallel to an axis of rotation defined by the axle when the first and second bodies rotate about the axis of rotation.

3. The yoyo of claim 1, wherein a pitch direction of the multiple second propeller blades of the second body is the same as a pitch direction of the multiple first propeller blades of the first body.

4. The yoyo of claim 1, further comprising a drum that forms a string seat that includes the axle.

5. The yoyo of claim 4, wherein:

the drum comprises:

a first drum included in the first body and at which inward ends of the multiple first propeller blades of the first body terminate; and a second drum included in the second body and at which inward ends of the multiple second propeller blades of the second body terminate;

the first drum includes a portion that extends axially from the first body to the second drum; and the second drum includes a portion that extends axially from the second body to the first drum.

6. The yoyo of claim 1, wherein a length of the string is at least four feet.

7. The yoyo of claim 6, wherein a length of the string is at least ten feet.

8. The yoyo of claim 1, wherein at least one of the first or second outer rim comprises a removable elastic band.

9. The yoyo of claim 1, wherein at least one of the first or second bodies includes a light emitter element.

10. The yoyo of claim 1, further comprising an arm structure rotatably coupled to at least one of the first body or the second body, wherein:

the arm structure includes an eyelet;

the eyelet is located radially beyond the first and second outer rims;

the eyelet at least partially spans the gap between the first and second bodies;

the string is threaded through the eyelet.

11. A yoyo, comprising:

a first body rotatable about an axis of rotation, the first body including a first outer rim and multiple first propeller blades that extend radially inward from the first outer rim;

a second body coupled to the first body and rotatable about the axis of rotation, the second body including a second outer rim and multiple second propeller blades that extend radially inward from the second outer rim; and a string seat that axially separates the first body from the second body by a gap and that defines the axis of rotation, wherein:

the first outer rim and the second outer rim have a same diameter;

a string is windable and unwindable about the string seat to cause rotation of the yoyo about the axis of rotation;

the gap between the first body and the second body is smaller than three times the diameter of the string;

the diameter of the string seat between the two bodies is no larger than one sixth of the diameter of each of the first outer rim and the second outer rim; and an aggregate mass of the first outer rim and the second outer rim is at least one quarter of the mass of the yoyo, string excluded.

12. The yoyo of claim 11, wherein the gap is bounded primarily by the first propeller blades of the first body on one side of the gap and by the second propeller blades of the second body on an opposite side of the gap.

13. The yoyo of claim 11, further comprising an arm structure rotatably coupled to at least one of the first body or the second body, wherein:

the arm structure includes an eyelet;

the eyelet is located radially beyond the first and second outer rims;

the eyelet at least partially spans the gap between the first and second bodies;

the string is threaded through the eyelet.

14. The yoyo of claim 13, further comprising a digital camera attached to the arm structure.

15. The yoyo of claim 11, further comprising:

a first drum included in the first body, the first drum comprising:

a first cylindrical wall at which inward ends of the first propeller blades of the first body terminate; and a first circular base from which the first cylindrical wall extends axially outward;

a second drum included in the second body, the second drum comprising:

a second cylindrical wall at which inward ends of the second propeller blades of the second body terminate; and a second circular base from which the second cylindrical wall extends axially outward;

wherein the first and second circular bases at least partially bound opposite sides of the gap.

16. The yoyo of claim 15, wherein the first circular base defines a hole through which the string is threaded from within the gap to an opposite outside of the first circular base, a portion of the string located at the opposite outside of the first circular base terminating in a knot to prevent the string from inadvertently passing through the hole.

17. The yoyo of claim 11, wherein at least some portions of each of the first and second bodies, excluding the first and second outer rims, are relatively thin-walled compared to the first and second outer rims.

18. The yoyo of claim 17, wherein:

a wall thickness of each of the first and second propeller blades is less than 1.5 millimeters (mm); and a wall thickness of each of the first and second outer rims is greater than 2 mm.

19. The yoyo of claim 18, wherein:

the wall thickness of each of the first and second propeller blades is less than 1 mm; and the wall thickness of each of the first and second outer rims is about 2.5 mm.

20. The yoyo of claim 11, wherein each of the first and second bodies comprises polycarbonate.

* * * * *